US006926118B1

(12) United States Patent
Stevens et al.

(10) Patent No.: US 6,926,118 B1
(45) Date of Patent: Aug. 9, 2005

(54) ANCHOR FOR PERSONAL FALL ARREST EQUIPMENT

(75) Inventors: Hans P. Stevens, Silverdale, WA (US); Thomas R. Palmer, Deer Park, WA (US); Stewart D. Adams, Gardiner, WA (US); Gerald A. McNeil, Bremerton, WA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 187 days.

(21) Appl. No.: 10/631,217

(22) Filed: Jul. 31, 2003

(51) Int. Cl.[7] ..... A47L 3/04; A47F 5/08
(52) U.S. Cl. ..... 182/3; 248/231.9
(58) Field of Search ..... 182/3, 4, 5, 6, 182/7, 8, 36, 230; 248/231.9, 925, 694; 294/28, 294/51

(56) References Cited

U.S. PATENT DOCUMENTS 4,491,291 A * 1/1985 Ching ..... 248/231.9
4,645,149 A * 2/1987 Lowe ..... 248/231.9
4,712,754 A * 12/1987 Brodie ..... 248/231.9
4,832,289 A * 5/1989 Waggoner ..... 248/231.9
5,156,233 A * 10/1992 Olsen et al. ..... 182/3
5,287,944 A 2/1994 Woodyard ..... 182/3
5,603,389 A 2/1997 Zemon ..... 182/133
5,845,452 A 12/1998 Pantano ..... 52/698
5,934,635 A * 8/1999 Bohn ..... 248/231.9
6,009,973 A * 1/2000 Woodyard ..... 182/36
6,354,399 B1 3/2002 Austin ..... 162/36
6,375,139 B1 * 4/2002 Murray et al. ..... 248/231.9
6,474,441 B1 * 11/2002 Bertolino ..... 182/3
2002/0014370 A1 2/2002 Casebolt et al. ..... 182/5

* cited by examiner

*Primary Examiner*—Hugh B. Thompson, II
(74) *Attorney, Agent, or Firm*—Mark Homer

(57) ABSTRACT

An anchor for positioning in an opening of a surface includes a first generally flat portion having a slot formed therein, the slot having a longitudinal centerline; a second generally flat portion having a slot formed therein, the slot having a longitudinal centerline coincident on a line with the longitudinal centerline of the slot of the first flat portion, the second generally flat portion including at least one opening formed therein that defines an attachment ring; a hinge that connects the first and second flat portions at ends opposite open ends of the slots; a latch rotatably connected to the first flat portion; and a pin for releasably connecting the latch to the second flat portion to thereby secure the anchor in an unfolded position.

5 Claims, 3 Drawing Sheets

ANCHOR FOR PERSONAL FALL ARREST EQUIPMENT

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to anchors for personal fall arrest equipment and in particular to an anchor for persons working on vertical surfaces.

Personal fall arrest equipment is used by those working at heights wherein a fall would most likely cause injury or death. Typically, the fall arrest equipment must be anchored in some manner. Various types of anchors are known. Exemplary anchors are disclosed in U.S. Patent Publication 2002/0014370; U.S. Pat. No. 6,354,399; U.S. Pat. No. 5,845,452; U.S. Pat. No. 5,603,389; and U.S. Pat. No. 5,287,944. However, the anchors disclosed in the above documents are not suitable for persons working on vertical baffles.

FIG. 1 is an elevation view of a vertical baffle 10 that is located, for example, inside the tank of a ship. The baffle 10 includes openings 12 formed therein. The purpose of the baffle is to help prevent ship instability by slowing the movement of liquid in the tank, while still allowing liquid movement through the openings 12. The openings 12 also function as hand-grab/foot-rest holes for workers. Periodically, the baffle 10 requires maintenance, such as cleaning, painting or welding.

A known method for securing personal fall arrest equipment to the baffle 10 is to wrap nylon sling material through two of the openings 12 and then secure the personal fall arrest equipment to the nylon sling. The nylon sling method requires two hands and exposes the worker to an extended time period working on the vertical baffle without fall protection. Additionally, the openings 12 do not have smooth edges and, therefore, abrade the nylon sling material.

The present invention is an anchor for personal fall arrest equipment that can be quickly and easily operated. The inventive anchor is not subject to abrasion from the rough edges of the openings 12. The invention can also be installed by one man using one hand.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
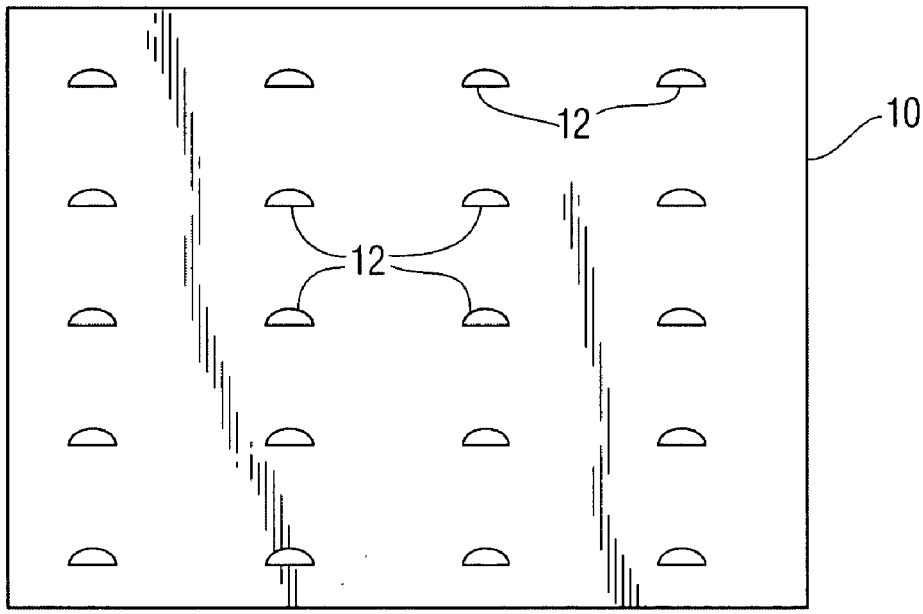
Fig. 1 PRIOR ART
FIG. 1 is an elevation view of a vertical baffle.
Figure 2:
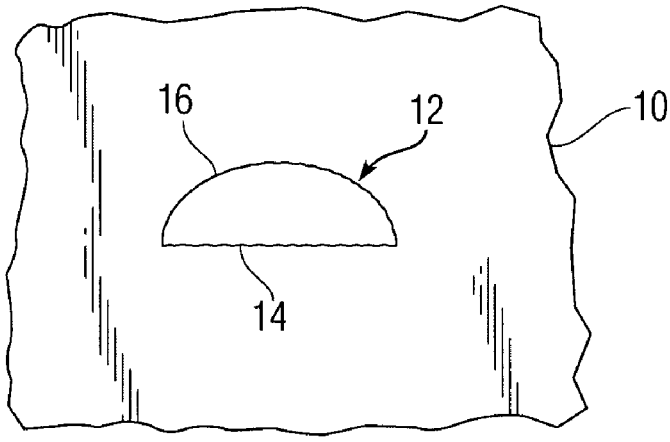
Fig. 2 PRIOR ART
FIG. 2 is an enlarged view of an opening in the baffle.

FIG. 2 is an enlarged view of an opening 12 in the baffle 10. The openings 12 are generally "D" shaped holes. The flat side 14 of the "D" is on the bottom. The half circle portion 16 typically has a 3¼" radius (plus or minus ¼"). The openings 12 are usually burned into the steel plate that forms the baffle bulkhead 10 and are arranged so they can be used as foot/hand holds like a ladder.

Figure 3:
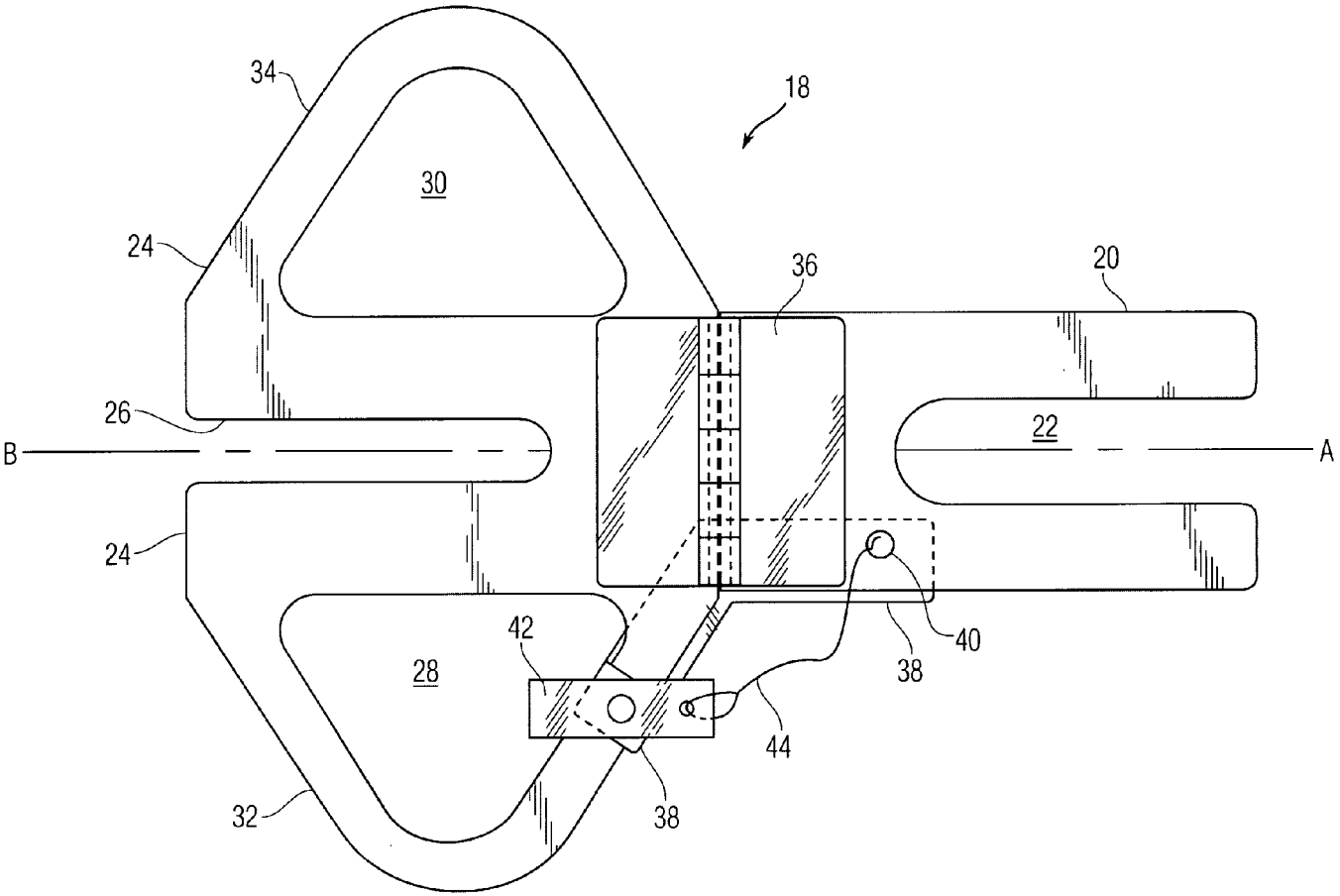
FIG. 3 is a top view of an anchor according to the invention.
Figure 4:
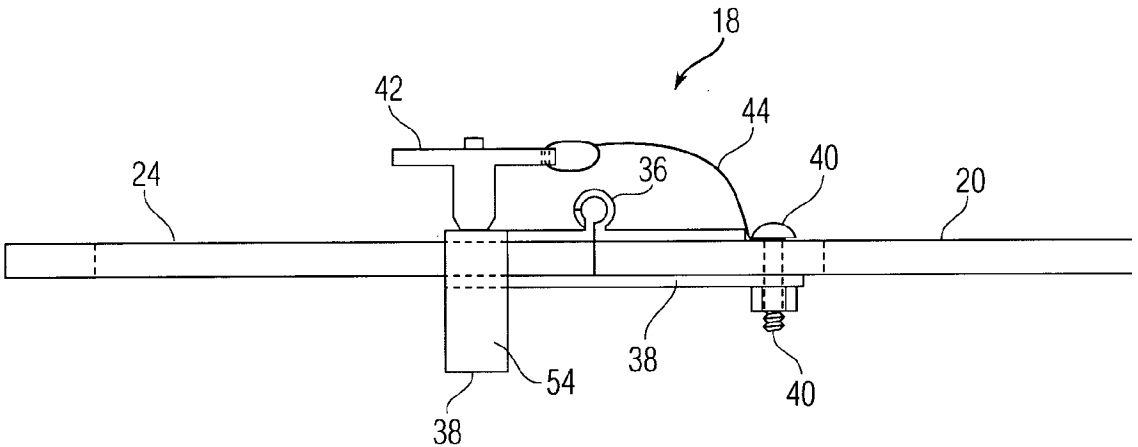
FIG. 4 is an elevation view of FIG. 3.

FIG. 3 is a top view of an anchor 18 according to the invention. FIG. 4 is an elevation view of FIG. 3. Anchor 18 comprises a first generally flat portion 20 having a slot 22 formed therein and a second generally flat portion 24 having a slot 26 formed therein. The longitudinal centerline A of slot 22 and the longitudinal centerline B of slot 26 are coincident on a single line. Second flat portion 24 includes at least one opening 28 formed therein that defines an attachment ring 32 for attaching personal fall arrest equipment. Second flat portion 24 may also include a second opening 30 formed therein that defines an attachment ring 34. A hinge 36 connects the first and second flat portions 20, 24 at ends of the flat portions 20, 24 opposite open ends of the slots 22, 26. A latch 38 is rotatably connected to the first flat portion 20.

Both latch 38 and first flat portion 20 have a hole formed therein for receiving a fastener 40 used to rotatably connect latch 38 to first flat portion 20. The fastener 20 may be, for example, a screw and nut. The fastener 20 is tightened enough to hold latch 38 and flat portion 20 together, while still allowing latch 38 to rotate with respect to flat portion 20. A pin 42, such as a quick release pin, releasably connects the latch 38 to the second flat portion 24. The pin 42 passes through holes formed in the second flat portion 24 and the latch 38. A piece of wire 44 may be attached to pin 42 and fastener 40 to prevent loss of pin 42 when pin 42 is removed from flat portion 24 and latch 38. In FIG. 3, latch 38 is mostly hidden by the flat portions 20 and 24.

Figure 6:
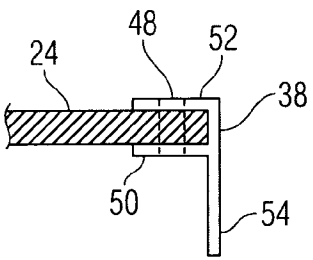
FIG. 6 is a partial side view of the latch of FIG. 5 taken along the line 6—6 of FIG. 5.
Figure 5:
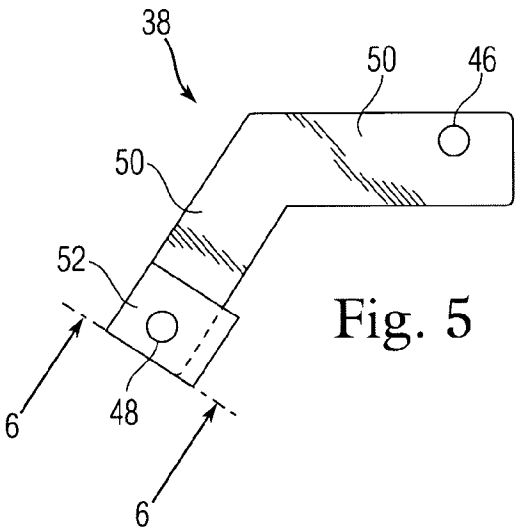
FIG. 5 is a top view of the latch.

FIG. 5 is a top view of latch 38. Opening 46 is where latch 38 is rotatably connected to flat portion 20 by fastener 40. Opening 48 is for receiving pin 42 when it is desired to lock anchor 18 in the flat position shown in FIGS. 3 and 4. Latch 38 includes a body portion 50 and a latching portion 52. FIG. 6 is a partial side view of latch 38 taken along the line 6—6 of FIG. 5 and also includes a sectional portion of flat portion 24. FIG. 6 shows how latch 38 locks anchor 18 in the flat or unfolded position of FIGS. 3 and 4. Latching portion 52 and body portion 50 form a recess to engage flat portion 24. Pin 42 is placed in hole 48 to lock flat portion 24 in place. With latch 38 secured to flat portion 20 with fastener 40 and to flat portion 24 with pin 42, anchor 18 is locked in a flat position. Latch 38 also includes a handle 54 that helps in grasping latch 38 to rotate it.

In use, initially latch 38 is rotatably connected only to flat portion 20 by fastener 40. Latch 38 is not initially connected to flat portion 24. The user folds anchor 18 along hinge 36 such that the letter A in FIG. 3 is folded over to the letter B in FIG. 3. In this folded position, the longitudinal centerlines A and B of slots 22, 26 are coincident. The folded anchor 18 is then placed in an opening 12 (FIG. 2) with the slots 22, 26 engaging one side of the half circle or arc 16. Anchor 18 is then unfolded to a flat position by rotating flat portion 20 up and away from flat portion 24 while keeping slots 22 and 26 engaged with arc 16. In the flat or unfolded position, slot 22 will engage one side of arc 16 and slot 26 will engage the opposite side of arc 16. Latch 38 is then rotated so that opening 48 in latch 38 lines up with the opening for pin 42 in second flat portion 24. Pin 42 is then inserted through opening 48 in latch portion 52, through the opening in flat portion 24 and the opening 48 in body portion 50. Latch 38 now locks anchor 18 in the unfolded, flat position and the anchor is ready for use. Personal fall equipment (not shown) is attached to one of the attachment rings 32, 34 in flat portion 24. In the method just described, attachment ring 32 would be used because attachment ring 34 would be partially obscured behind baffle 10.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An anchor for positioning in an opening of a surface, the anchor comprising:

a first generally flat portion having a slot formed therein, the slot having a longitudinal centerline;

a second generally flat portion having a slot formed therein, the slot of the second flat portion having a longitudinal centerline coincident on a line with the longitudinal centerline of the slot of the first flat portion, the second generally flat portion including at least one opening formed therein that defines an attachment ring;

a hinge that connects the first and second flat portions at ends opposite open ends of the slots;

a latch rotatably connected to the first flat portion; and a pin for releasably connecting the latch to the second flat portion to thereby secure the anchor in an unfolded position.

2. The anchor of claim 1 wherein the second generally flat portion includes a second opening formed therein that defines a second attachment ring.

3. The anchor of claim 1 further comprising a fastener that rotatably connects the latch to the first flat portion.

4. The anchor of claim 1 wherein the latch includes a body portion and a latch portion, the body portion and the latch portion forming a recess to receive the second flat portion.

5. The anchor of claim 4 wherein the latch includes a latch handle.

* * * * *